US011376711B2

(12) United States Patent
Linde

(10) Patent No.: US 11,376,711 B2
(45) Date of Patent: Jul. 5, 2022

(54) NOZZLE HEAD

(71) Applicant: ANT APPLIED NEW TECHNOLOGIES AG, Lübeck (DE)

(72) Inventor: Marco Linde, Lübeck (DE)

(73) Assignee: ANT APPLIED NEW TECHNOLOGIES AG, Lübeck (DE)

( * ) Notice: Subject to any disclaimer, the term of this patent is extended or adjusted under 35 U.S.C. 154(b) by 0 days.

(21) Appl. No.: 15/119,493

(22) PCT Filed: Feb. 19, 2014

(86) PCT No.: PCT/EP2014/053259
§ 371 (c)(1),
(2) Date: Aug. 17, 2016

(87) PCT Pub. No.: WO2015/124182
PCT Pub. Date: Aug. 27, 2015

(65) Prior Publication Data
US 2017/0008150 A1 Jan. 12, 2017

(51) Int. Cl.
*B24C 3/04* (2006.01)
*B05B 1/02* (2006.01)
*B05B 3/02* (2006.01)

(52) U.S. Cl.
CPC ..... *B24C 3/04* (2013.01); *B05B 1/02* (2013.01); *B05B 3/025* (2013.01)

(58) Field of Classification Search
CPC ..... B05B 3/025; B05B 3/028; B05B 3/0409; B05B 3/0418; B05B 3/0422; B05B 3/0427; B05B 3/0445; B05B 3/0463; B05B 3/0495
USPC ..... 239/227, 237, 239, 240, 243, 244, 245, 239/263, 264, 380–389, 501
See application file for complete search history.

(56) References Cited

U.S. PATENT DOCUMENTS 1,541,702 A * 6/1925 Geisendorfer ..... B05B 3/0427 239/240
2,548,616 A * 4/1951 Priestman ..... E21B 19/22 175/103
3,109,262 A * 11/1963 Weaver ..... B24C 3/325 15/104.12
3,212,217 A * 10/1965 Furgason ..... B24C 5/02 239/424
4,340,179 A * 7/1982 Knapp ..... A01C 23/042 239/310
4,370,304 A * 1/1983 Hendriks ..... C01B 25/28 239/472
4,534,427 A * 8/1985 Wang ..... B26F 3/004 175/67
4,708,214 A 11/1987 Krawza et al.
(Continued)

FOREIGN PATENT DOCUMENTS

CN 202516801 U 11/2012
CN 103447253 A 12/2013
(Continued)

*Primary Examiner* — Christopher S Kim
(74) *Attorney, Agent, or Firm* — McGlew and Tuttle, P.C.

(57) ABSTRACT

A nozzle head (1) for discharging a suspension which is under pressure and which includes a fluid and abrasive agent, with at least one nozzle (8) including at least one exit opening (20) for the exit of the suspension. The nozzle head (1) includes at least one first drive device (17'), by way of which the nozzle head can be rotated about a first axis (A1).

3 Claims, 4 Drawing Sheets

(56) References Cited

U.S. PATENT DOCUMENTS

| | | | | |
|---|---|---|---|---|
| 5,009,368 | A * | 4/1991 | Streck | A01G 25/16 239/240 |
| 5,518,553 | A * | 5/1996 | Moulder | B60S 3/008 134/167 R |
| 6,422,480 | B1 | 7/2002 | Richmond | |
| 2002/0109017 | A1 | 8/2002 | Rogers et al. | |
| 2012/0286065 | A1* | 11/2012 | Lin | B05B 3/0409 239/225.1 |

FOREIGN PATENT DOCUMENTS

| | | | |
|---|---|---|---|
| EP | 1 820 604 | B1 | 8/2009 |
| EP | 2 308 645 | A1 | 4/2011 |
| WO | 2008/007084 | A1 | 1/2008 |
| WO | 2008/128303 | A1 | 10/2008 |

* cited by examiner 22
3
20
6
32
1
17'
17"
2
4
S
21
A1
19
30
X
α

NOZZLE HEAD

CROSS REFERENCE TO RELATED APPLICATIONS

This application is a United States National Phase Application of International Application PCT/EP2014/053259 filed Feb. 19, 2014, the entire contents of which are incorporated herein by reference.

FIELD OF THE INVENTION

The invention relates to a nozzle head for the discharge of a suspension consisting of fluid and solid particles with at least one nozzle comprising at least one exit opening for the exit of the suspension.

BACKGROUND OF THE INVENTION

Such nozzles heads are applied for example in facilities for water-jet cutting, for drilling by way of water jet, or in another manner for surface material removal.

With these methods, the material to be machined (processed) is machined by way of a high-pressure water jet amid the addition of abrasive agent. The advantage of this type of machining is the fact that almost all materials can be machined and that the material to be cut is thereby hardly heated.

It is known from the state of the art, to use a water-abrasive jet, to which a cutting agent, a so-called abrasive agent (e.g. garnet sand, glass, slag, olivines, corundum, or the like) is added, for increasing the cutting or drilling performance or also the machining quality, particularly in the case of hard materials. A suspension of water and abrasive agent is formed for this, in the case of water-abrasive suspension cutting, and this suspension is discharged from a nozzle at a high pressure.

A nozzle head for discharging a suspension comprising a fluid as well as an abrasive agent is known for example from EP 1 820 604 B1. The nozzle head comprises at least one nozzle arranged in a stationary manner, with an exit opening, through which opening the fluid is discharged into the atmosphere. A flow guidance element is arranged upstream of the at least one nozzle, so that this is effected in an as defined as possible manner, thus in order to achieve a desired cutting or material removal result. This flow guidance element is arranged upstream of the nozzle and its exit opening, in the flow path of the fluid led to the nozzle, so that the fluid must firstly pass the flow guidance element before it reaches the nozzle and the exit opening. The flow guidance element is designed and arranged in a manner such that it brings the fluid to be discharged into rotation about the longitudinal axis of the flow path, downstream of the nozzle.

This rotation of the fluid on the one hand leads to a widening of the jet of the fluid after the exit from the nozzle, so that the fluid exits the nozzle in a cone-like manner and a diameter of the fluid flow at a distance to the exit opening downstream of the nozzle and which is larger than the diameter of the exit opening is achieved. On the other hand, the material removal performance is improved by way of the rotating fluid flow exiting from the nozzle.

SUMMARY OF THE INVENTION

Against this background, it is an object of the present invention, to provide a nozzle head for discharging a suspension of a fluid and of an abrasive agent, by way of which nozzle head the effects described above are improved to an even greater extent.

According to the invention, thus a nozzle head for the discharge of a suspension consisting of fluid and abrasive agent and with at least one nozzle comprising at least one exit opening for the exit of the fluid or liquid is provided, wherein the nozzle head is preferably configured for movement along a feed axis. The nozzle head moreover comprises at least one first drive device, by way of which the nozzle head is rotatable about a first axis which preferably runs parallel to the feed axis. An increased material removal and the machining of a larger surface can be realized due to the fact that the nozzle head itself is brought into rotation about an axis, in particular parallel to the feed axis or in the feed axis.

Not only water, but also any other suitable fluid can be used as a fluid to be discharged. Thus, the fluid with regard to its viscosity can be adapted to the ambient pressure, in particular when using water. Suitable materials such as e.g. garnet sand, glass, slag, olivines, corundum, or the like, can be used as abrasive agent.

The first axis preferably runs parallel to the longitudinal axis of the nozzle head, wherein the longitudinal axis is that axis, in whose direction the flow through the nozzle head is effected. This longitudinal axis is preferably the middle axis of the nozzle head and further preferably corresponds to the feed axis, along which the nozzle head is fed which is to say advanced, for example when forming a bore (drill hole).

Furthermore, at least one flow guidance element can be arranged preferably upstream of the at least one nozzle, in a manner such that the fluid to be discharged is brought into rotation upstream of the nozzle. As already described, a cone-like widening of the jet can be achieved by way of this, and this jet permits a removal of material in a particularly effective manner. The abrasive agent exiting out of the nozzle in the suspension in particular moves on a circular path.

In particular, a spiral or worm-like flow path can be applied as a flow guidance element. Thereby, the screw (worm) defining the flow path in particular can also be designed in a multi-flight manner, for example with three flights. A spiral or screw structure can be designed as an insert or for example as a spiral-shaped path on the inner periphery of a flow channel or on the outer periphery of a middle wall of an annular flow channel.

According to a preferred embodiment, the first axis coincides with the longitudinal or feed axis, so that the nozzle head executes a concentric rotation about its longitudinal axis on machining the material, e.g. on cutting through a metal or on carrying out a drilling.

Alternatively, the first axis can also be arranged distanced to the longitudinal axis or feed axis. An increase of the machining cross section can be achieved by way of this. The nozzle head can thereby either execute a concentric circular movement, but also an eccentric movement. Thus, for example, the longitudinal axis of the nozzle head with the nozzle head can rotate on a circular path about the first axis. Thereby, the feed is then preferably effected along a feed axis extending in the direction of the first axis. If the first axis lies distanced to the feed axis, in particular distanced to it in a normal or parallel manner, then the nozzle head rotates about an axis which is not coincident with the feed axis, i.e. about its longitudinal axis which is offset to the feed axis.

The first axis preferably runs parallel to the longitudinal axis and/or to the feed (advance) axis of the nozzle head. The axes can however also run angled to one another, in particular for example if the nozzle head is arranged angled to the feed (advance) direction, i.e. the longitudinal axis of the nozzle head extends in a manner angled to the feed axis. In this case, the first rotation axis for example can be arranged parallel to the longitudinal axis of the nozzle head or parallel to the feed axis.

According to a further embodiment, the nozzle head comprises a second drive device, by way of which the nozzle head is additionally rotatable about a second axis distanced to the first axis. If the machining is carried out by way of a rotation about the first and the second axis, then not only can an improvement of the machining performance be achieved, but also an increase of the machining cross section. Thus, for example, the first axis can be arranged such that the nozzle head rotates about its longitudinal axis which is distanced to the feed axis in the radial direction. The second axis then for example can run along the feed axis, so that the longitudinal axis and accordingly the first axis of the nozzle head carries out a movement on a circular path about the second axis.

The nozzle head moreover at least in a section which comprises the at least one exit opening can be inclined to the feed axis by an angle $\alpha$. The machining cross section about the feed axis can also be increased by way of this, wherein the machining geometry can also be simultaneously changed. The material removal performance can alternatively also be increased by way of inclining the exit opening.

According to a preferred embodiment, the nozzle head comprises a nozzle, in particular a centrally arranged nozzle.

The nozzle head however can also be provided with a multitude of exit openings, of which preferably at least some are arranged such that they release jets which are angled to one another. This configuration of the nozzle head moreover improves the machining performance and, depending on the arrangement of the exit openings, permits the realization of special cutting and machining geometries. Thus, the several exit openings can be arranged or inclined to one another, such that the jets which are produced by them, or their middle axes are directed to one another. I.e. the middle axes of the several jets preferably meet at one point which is to say a focus. Alternatively, the middle axes of the several jets can be directed to one another, without intersecting. This means that the middle axes of the jets in an incident/impinging plane of the jets define a smaller area than in the region of the exit plane. The material removal performance can be increased by way of this. Alternatively, the several exit openings can be arranged such that their jets or their middle axes diverge from one another, so that a greater machining area or surface is covered.

According to a further preferred embodiment, the first and/or the second drive device comprises a motor. With such a motor, it can be the case for example of an electrical motor, but also of a hydraulic or pneumatic motor. This design permits a drive which is independent of the suspension flow. In the case that two drive devices are provided, these can each comprise separate motors of this type, so that these can be driven independently of one another, in particular such that the rotations can be controlled independently of one another Alternatively, such a motor can also be provided for two drive devices, wherein the drive devices e.g. comprise gears which are connected to the common drive motor.

A hydraulic motor can also be driven itself by the suspension flow or a fluid flow which is branched out of the suspension.

In particular, the first and/or the second drive device for this can comprise a turbine driven by the fluid flow, or another drive driven by the fluid flow. This design has the advantage that one can make do without an additional drive, such as e.g. an electrical drive, and in particular no additional separate energy supply from the outside is necessary. Thereby, each drive device can comprise a turbine, or a turbine can be provided for the drive of both drive devices. Such a turbine for example can comprise one or more blade wheels, through which blade wheel or blade wheels the fluid flow flows and which is/are brought into rotation. The rotation can then be transmitted onto the drive for rotating the nozzle head, for example via a suitable gear. I.e. the drive in this case is connected to at least one blade wheel. Another suitable drive could be realized by way of displacement elements such as moving pistons in the form of a hydraulic motor.

In particular, it is advantageous if at least one channel is provided in the nozzle head, via which channel fluid can be branched off out of the suspension essentially without any solid particles. This is possible for example if the suspension is brought into rotation by a flow guidance element, as described above. When the suspension rotates, this leads to the particles or the abrasive agent being moved outwards on account of the arising centrifugal forces, whereas the fluid, in particular water, collects in a middle region. If the mentioned channel then leads into the middle region, then here fluid or liquid can be branched off out of the suspension flow, essentially without any abrasive agent. This can be effected in a branching chamber which is connected downstream of the flow guidance element. The channel, via which the fluid can be branched out of the suspension, is further preferably connected to the turbine described above, so that this can be driven by the suspension flow with pure fluid essentially without any abrasive agent. Thus, one prevents abrasive agent of the suspension from being able to damage the turbines. A drive which can forgo an additional separate energy feed can simultaneously be created.

The nozzle head is particularly preferably arranged on a device for water-jet cutting or water-jet drilling, in particular water-abrasive suspension cutting. Such a device for water-jet cutting or water-abrasive suspension cutting with a nozzle head, as has been described beforehand, is likewise the subject-matter of the invention. Such a device as essential constituents moreover comprises a high-pressure pump which brings a fluid, in particular water to an adequately high pressure. The fluid which is under pressure is subsequently led for example through an abrasive agent container, in which it is mixed with the abrasive agent for forming the suspension. It is then led further to the described nozzle head.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
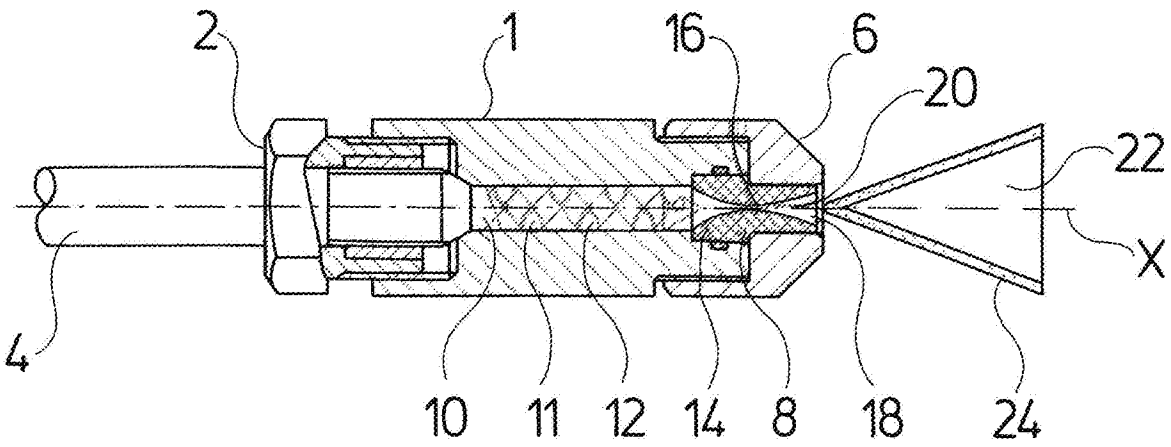
Fig.1 prior art
FIG. 1 is a sectioned view through a nozzle head according to the state of the art.

Referring to the drawings, FIG. 1 is a sectioned view through a nozzle head 1 according to the state of the art, which is suitable for the discharge of a suspension consisting of a fluid or liquid and abrasive particles which are contained therein. The nozzle head 1 at its face end 2 which is at the rear in the flow direction comprises a connection conduit 4 which is releasably connected to the nozzle head 1. The actual nozzle 8 in the form of an insert is arranged at the opposite face end 6, i.e. at the face end 6 which is at the front in the flow direction. A central passage 10 which extends from the rear face end 2 to the front face end 6 and which forms a fluid conduit extending along the longitudinal axis X of the nozzle head is formed in the inside of the nozzle head 1. The longitudinal axis X thus simultaneously forms the flow direction, in which the fluid flows from the connection conduit 4 to the nozzle 8, through the inside of the nozzle head. A flow guidance element 12 in the form of a screw (worm) is arranged in the passage 10. This screw in its spiral defines a spiral-shaped flow path from the end of the fluid guidance element 12 which faces the rear face end 2 to the end of the flow guidance element 12 which faces the nozzle 8. The worm of the flow guidance element 12 ends shortly in front of the nozzle body which is to say the nozzle 8.

The flow guidance element 12 has the effect that the fluid/suspension which, coming from the connection 4 flows through the passage 10 in the flow direction, must flow spirally through the channel defined by the screw, when it flows through the flow guidance element 12, so that additionally to its movement in the direction of the longitudinal axis X, it undergoes a rotational movement about the longitudinal axis X. The flow retains this rotatory speed component on exit of the fluid out of the flow guidance element 12 towards the nozzle 8, and apart from its axial movement in the direction of the longitudinal axis X simultaneously executes a rotational movement about this axis. The fluid then flows in this spiral movement into the run-in funnel 14 of the nozzle 8. The run-in funnel 14 narrows towards a channel 16 which extends in the inside of the nozzle 8 in the direction of the longitudinal axis X. The channel 16 defines the smallest cross section of the nozzle 8 normally to the longitudinal axis X.

In this example, the channel 16 widens further downstream into a run-out funnel 18. The run-out funnel 18 thus connects to the actual exit opening 20 at the downstream end of the channel 16. A run-out funnel 18 does not need to be provided in each case.

On entry of the fluid into the run-in funnel 14, the fluid flow is accelerated towards the channel 16 on account of the reducing cross section. The rotation effect of the flow is retained on entry of the flow into the run-in funnel 4 and into the channel 16, so that a conical fluid jet 22 widening in the flow direction along the longitudinal axis X is formed on exit of the flow out of the exit opening 20 through the run-out funnel 18.

The abrasive agent in the fluid is pressed outwards on account of the centrifugal force due to the rotation of the flow in the screw of the flow guidance element 12 and further downstream, due to the fact that the abrasive agent has a greater mass than the fluid or the carrier fluid, in which it is located. This effect is retained within the run-in swirl which forms in the run-in funnel 14 and within the channel 16 of the nozzle 8, so that the abrasive gent, after the exit out of the nozzle through the run-out funnel 18, in the liquid jet 22 forms a hollow cone 24 and the abrasive agent is displaced to the outer periphery of the conical fluid jet 22. The abrasive agent in the fluid jet 22 thus in cross section normal to the longitudinal axis X forms an annulus area. The annulus area or surface is also essentially retained on impinging an object. The rotationally energy in the fluid jet 22 still acts on impinging the object, by which means the material-removal energy of the abrasive agent is increased on material removal, so that an improved material removal performance can be achieved.

Figure 2:
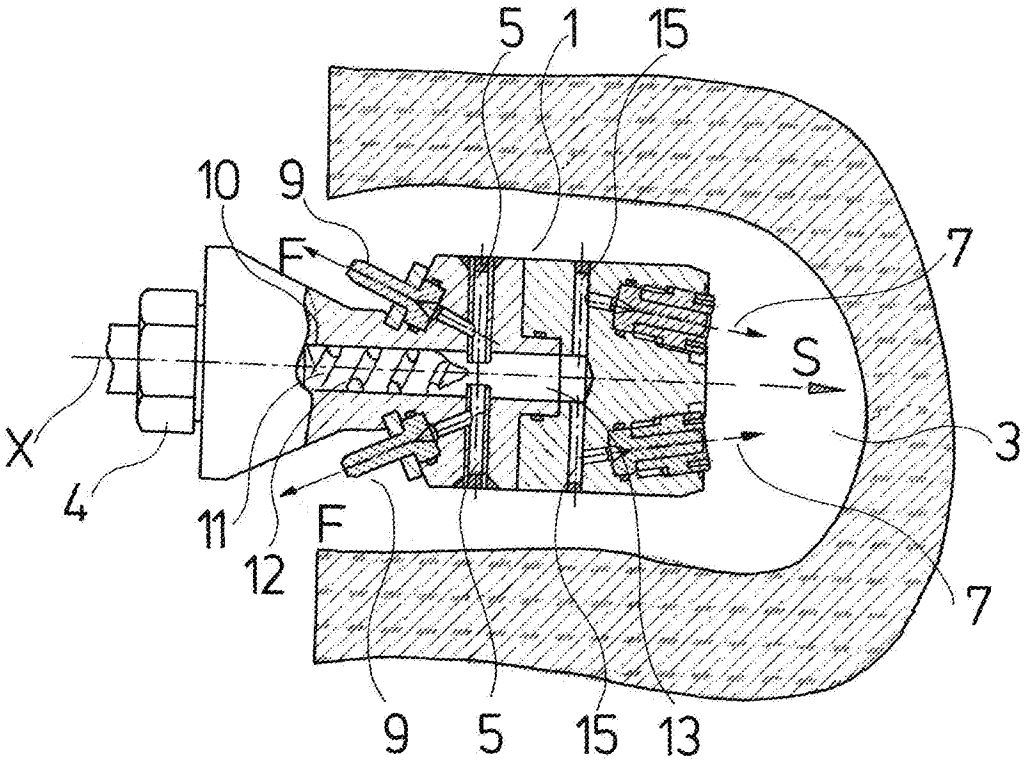
Fig.2 prior art
FIG. 2 is a sectioned view through a further nozzle head according to the state of the art.

FIG. 2 shows a sectioned view through a further nozzle head 1 according to the state of the art, with which several first nozzles 7 which are directed in a feed direction S of the nozzle head 1, and several second rearwardly directed nozzles 9, are arranged on the nozzle head 1. The nozzle head 1 here is shown on application in a drill hole 3, in which it is advanced in the feed direction S. The second nozzles 9 are provided, in order to be able to deliver or convey the removed material out of the drill hole 3 counter to the feed direction S. These second nozzles departing from the nozzle head 1 are directed radially obliquely to the rear, i.e. obliquely counter to the feed direction S. The second nozzles 9 are connected via connection conduits or channels 5 to the region 13 of the passage 10 which is situated downstream of the flow guidance element 12 and which forms a central flow conduit and branching chamber. Thereby, the connection conduits 5 project into the central region of the region 13, so that the entry openings of the connection conduits 5 which are away from the second nozzles 9 are situated distanced to the outer periphery of the region 13 of the passage 10. This has the effect that of the suspension located in the inside of the region 13, only fluid from the central region, but not abrasive agent from the peripheral region, is led into the connection conduits 5 and thus to the second nozzles 9, and from there this fluid exits in the direction specified by the reference numeral F. The abrasive agent in a suspension is pressed towards the outer periphery of the region 13 by way of the centrifugal force due to the rotation of the fluid which is produced by the flow guidance element 12, so that in the region 13 it is located in a peripheral region situated between the entry openings of the channels or connection conduits 5, and the peripheral wall. In this manner, one succeeds in the abrasive agent not entering into the connection conduits 5, but only the fluid located in the central region. Thus, one succeeds in essentially only fluid which flushes away material removed by the face side 6 of the nozzle head 1 in the bore hole 3, to the rear counter to the feed direction S parallel to the connection conduit 4, exiting from the second nozzles 9. No abrasive agent is necessary for the flushing procedure, wherein the abrasive agent is essential for the material removal by way of the suspension exiting from the first nozzles 7. The channels 5 therefore serve for branching essentially pure fluid out of the suspension. The nozzles 9 can moreover assist a rotation of the nozzle head about its longitudinal axis X given a suitable alignment.

Thus different fluids are discharged from the second nozzles 9 and the first nozzles 7, specifically a suspension out of the first nozzles 7 and essentially only carrier fluid, preferably water, out of the second nozzles 9, whereas however only one suspension needs to be fed through the connection conduit 4 to the nozzle head 1. A separation into a suspension with a higher concentration of abrasive agent and only fluid for flushing is effected in the nozzle head 1 itself, by which means additional feed conduits for the feed of rinsing fluid become superfluous.

The flow guidance element 12 in the form of a screw and which here is likewise arranged in the central passage 10 and mentioned above defines the spiral-shaped flow channel 11 which has the effect that the flow is brought into rotation in the way and manner which has already been described in the context of FIG. 1. This rotation is also retained by the fluid or suspension in the downstream region 13 of the passage 10, from which region the connection channels 15 branch off to the first nozzles 7. The connection channels 15 thereby are connected to the face side end of the passage 10 which is at the front in the flow direction, at the outer periphery of the region 13, so that one succeeds in the fluid or the suspension flowing into the connection channels 15 and then being led to the first nozzles 7. The rotation of the suspension in the inside of the region 13 thereby effects a uniform distribution of the suspension onto several connection channels 15.

Figures 3, 4, 5, 6, 7, 8:
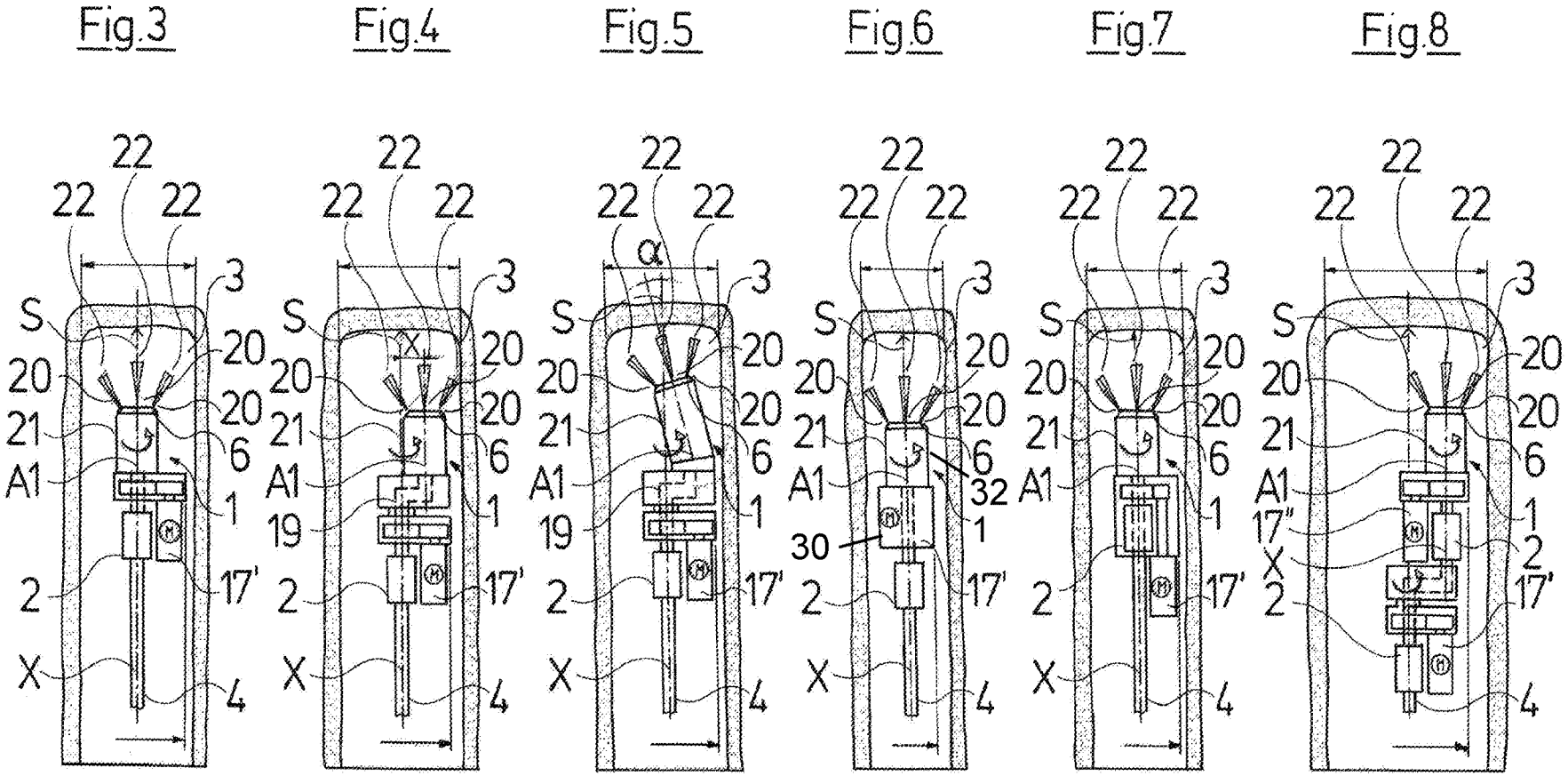
FIG. 3 is a sectioned view through a drill hole with a nozzle head, according to one embodiment of the invention.
FIG. 4 is a sectioned view through a drill hole with a nozzle head, according to a further embodiment of the invention.
FIG. 5 is a sectioned view through a drill hole with a nozzle head, according to yet a further embodiment of the invention.
FIG. 6 is a sectioned view through a drill hole with a nozzle head, according to yet a further embodiment of the invention.
FIG. 7 is a sectioned view through a drill hole with a nozzle head, according to yet a further embodiment of the invention.
FIG. 8 is a sectioned view through a drill hole with a nozzle head, according to yet a further embodiment of the invention.

FIG. 3 is a sectioned view through a drill hole with a nozzle head 1 which is arranged therein, according to an embodiment of the invention, and this nozzle head at its front end 6 is provided with several exit openings 20 which radially to the outside each release a fluid jet 22 from the nozzle head 1. The nozzle head 1 in the inside is provided with several nozzles 8 and in each case with a flow guidance element, wherein the construction basically corresponds essentially to the embodiments described in the context of FIGS. 1 and 2. In contrast to the nozzle heads 1 which are known from the state of the art, in the embodiment according to the invention and which is represented here, the complete nozzle head 1 here however is additionally brought into rotation, in order to further improve the material removal performance. For this, the nozzle head 1 comprises a first drive device 17' in the form of a motor, e.g. an electrical motor, by way of which the nozzle head 1 is rotated about a first axis A1 which in this case coincides with the feed direction S and the longitudinal axis X of the nozzle head. As can be recognized here, on account of this, the nozzle head 1 is capable of being rotated concentrically about the feed axis S, along which it is fed, which is to say advanced. If for example a motor driven by water flow e.g. a turbine is used as a first drive device 17' instead of an electrical motor, then the configuration of the nozzle head 1 which is represented in FIG. 2 is advantageous, according to which configuration the connection conduits 5 only branch off water or carrier fluid out of the suspension. The channels or connection conduits 5 for this are then connected to the turbine which forms the first drive device 17'. One can therefore make do without a separate feed of energy for the first drive device 17', and the drive device 17' can be driven directly by the suspension flow which is to say the fluid which is branched from this. The fluid can be admixed again to the suspension flow at the exit side of the turbine.

FIG. 4 is a sectioned view through a drill hole with a nozzle head 1 according to a further embodiment of the invention and this differs from the embodiment represented in FIG. 3 first and foremost by the fact that the first axis A1 which coincides with the feed axis S of the nozzle head, is radially offset or distanced to the longitudinal axis X by a distance x, so that the nozzle head 1 here is rotated about its feed axis S in a distanced manner. Hereby too, the first drive device 17' is also connected to the rear end 2 of the nozzle head 1. E.g. a larger diameter D (see FIG. 9*c*) of the drill hole 3 can be realized due to the distanced rotation of the nozzle head 1. The first drive device 17' as in FIG. 3, is here also arranged between the rotation feed-through 2 and the housing 21 of the nozzle head 1.

FIG. 5 is a sectioned view of a drill hole with a nozzle head 1 according to yet a further embodiment of the invention which corresponds essentially to the embodiment represented FIG. 4, but with the difference that the nozzle head 1 with its longitudinal axis X is tilted to the feed direction or the feed axis S by an angle $\alpha$. Another drill hole geometry (see FIG. 9B) can be realized e.g. during the machining due to the angled arrangement of the nozzle head 1.

FIG. 6 is a sectioned view of a drill hole with a nozzle head 1 according to yet a further embodiment of the invention. The difference to the embodiment represented in FIG. 3 lies in the arrangement of the first drive device 17' here not being arranged laterally to the housing 21 of the nozzle head 1 as in the embodiment represented in FIG. 3, but lying centrally in front of this considered in the flow direction, as a hollow shaft drive, so that the spatial requirement of the complete construction or its total diameter d is reduced compared to the embodiments which are represented in FIG. 3 to FIG. 5.

FIG. 7 is a sectioned view of a drill hole with a nozzle head 1 according to yet a further embodiment of the invention which differs from the embodiments represented in FIG. 3 and FIG. 6 in that the first drive device 17' here is not arranged between the rotation feed-through 2 serving as a connection part for the connection conduit 4, and the housing 21, but that the rotation feed-through 2 is integrated into a gear, by way of which the nozzle head 1 is rotated by the drive device 17'.

FIG. 8 is a sectioned view of a drill hole with a nozzle head 1 according to yet a further embodiment of the invention. This embodiment differs from the previously described embodiments in that here the movements of the embodiments represented in FIG. 3 and in FIG. 4 are superimposed. For this, the nozzle head 1 is rotated in a centric rotation about the first axis (A1) (corresponds to the longitudinal axis X) by way of a first drive device 17', and simultaneously is rotated in an eccentric rotation about a second axis A2 corresponding to the feed axis S, by way of a second drive device 17". The first axis A1 and the second axis A2 as well as the feed axis S are arranged parallel to one another. However, the first axis A1 and the second axis A2 are distanced to one another. Two rotation feed-throughs 2 are provided for permitting the two rotation movements.

FIG. 9A to 9D are respective sectioned views of drill holes each with a nozzle head 1 according to fourth further embodiments of the invention, which differ essentially from the embodiments represented in FIG. 3 to FIG. 7 in that here in each case only a single exit opening 20 arranged centrally in the middle of the front end 6 of the nozzle head 1 is present instead of several exit openings 20 which are supplied by several suitable nozzles arranged in the housing 21. As can moreover be recognized here, two exit openings 23 are arranged on the outer periphery of the nozzle head 1 and these are supplied by second nozzles which are not represented here and which are directed obliquely counter to the feed direction S and, in a manner corresponding to the embodiment represented and described in the context of FIG. 2, release fluid in the direction F, in order to flush away material removed in the drill hole 3, to the rear counter to the feed direction S, parallel to the connection conduit 4. Otherwise, disregarding the differences mentioned above, the nozzle head 1 represented in FIG. 9A corresponds essentially to the embodiment which is described in the context of FIG. 3, the nozzle head 1 represented in FIG. 9B to the embodiment represented in FIG. 5, the nozzle head 1 represented in FIG. 9C to the embodiment represented in FIG. 4 and the nozzle head 1 represented in FIG. 9D to the embodiment represented in FIG. 8.

Figure 9A:
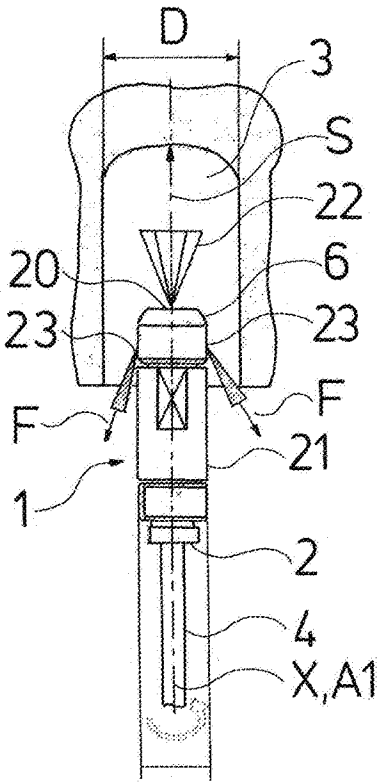
FIG. 9A is a sectioned view through a drill hole, with a nozzle head according to one of four further embodiments of the invention.
Figure 9B:
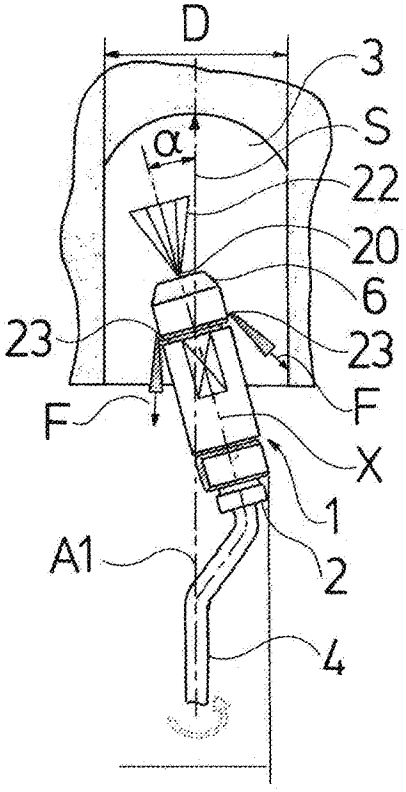
FIG. 9B is a sectioned view through a drill hole, with a nozzle head according to one of four further embodiments of the invention.
Figure 9C:
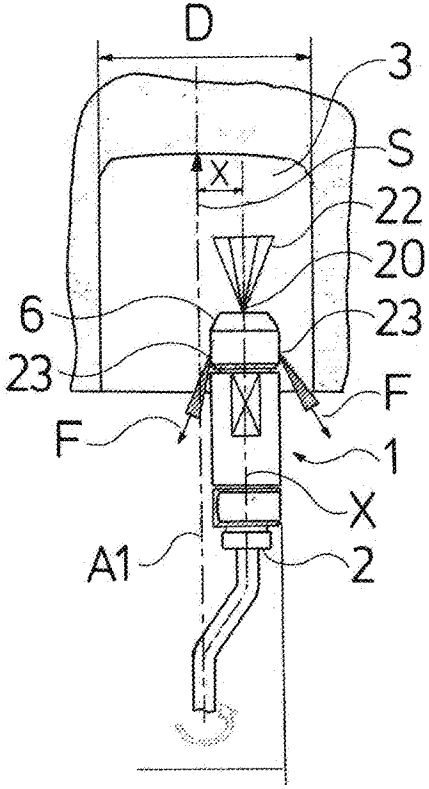
FIG. 9C is a sectioned view through a drill hole, with a nozzle head according to one of four further embodiments of the invention.
Figure 9D:
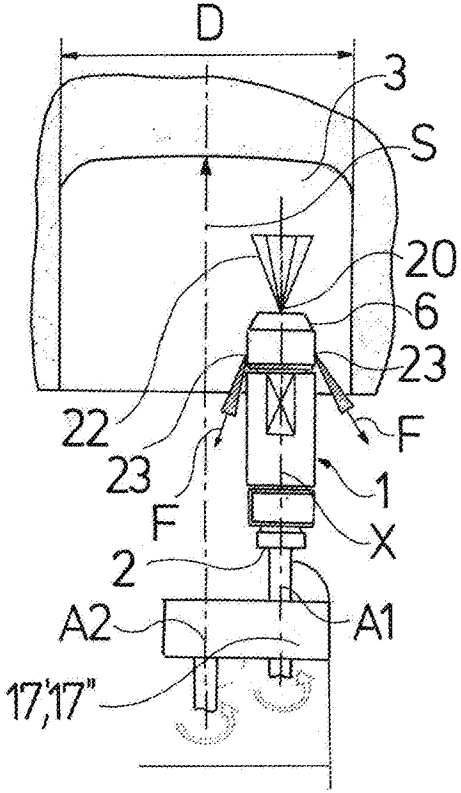
FIG. 9D is a sectioned view through a drill hole, with a nozzle head according to one of four further embodiments of the invention.

Concerning the previously described embodiments, it is to be understood that individual features here can be combined with one another also in another manner. Thus, all drive devices 17', 17" about the axes A1 and/or A2 are designed for example as electrical drives or as water drives, e.g. with turbines, wherein such water drives are preferably supplied with fluid via the connection conduits 5 described above by way of FIG. 2. Moreover, it is to be understood that the individual drive or rotation concepts can also be combined with the different nozzle designs. Thus, several or only one exit opening 20 can be selectively provided in all embodiment examples. The several exit openings 20 which are represented in the FIGS. 2-8 moreover also do not have to be arranged such that their jet directions are directed away from one another, but in contrast the exit openings 20, as is also shown in FIG. 2, can also be arranged such that their jet directions face one another which is to say are directed to one another, wherein the middle axes however preferably do not intersect. It is also to be understood that the nozzle head could also be arranged inclined which is to say angled, as is shown in FIGS. 5 and 9B, also with the other embodiments. Moreover, it is to be understood that the nozzles 8 in the shown embodiment examples can also be arranged such a flow guidance element 12 in the form of a spiral can be assigned to each nozzle, as is represented in FIG. 1. Alternatively, a design, as is shown in FIG. 2, and with which a flow guidance element is situated in the flow path upstream of all or at least several exit openings, can alternatively be selected in the embodiment examples with several nozzles or exit openings 20.

The essential concept of the invention lies in bringing the nozzle head into rotation about an axis by way of a separate drive, wherein the suspension, as explained by way of FIGS. 1 and 2, preferably for its part is simultaneously brought into rotation in the inside of the nozzle head.

While specific embodiments of the invention have been shown and described in detail to illustrate the application of the principles of the invention, it will be understood that the invention may be embodied otherwise without departing from such principles.

The invention claimed is:

1. A device for water abrasive cutting, the device comprising:

a water abrasive cutting device structure comprising:

a pressure pump;

a suspension comprising a fluid and an abrasive agent;

a fluid driven motor driven via a flow of the suspension;

a nozzle head comprising an outer nozzle head peripheral surface located at one end of the nozzle head, the outer nozzle head peripheral surface defining at least a portion of a nozzle head outlet, the nozzle head outlet defining at least a portion of a suspension flow path for discharging the suspension for a fluid abrasive cutting to machine and cut a surface of a material, the nozzle head being rotatable about a first axis via the fluid driven motor, wherein the nozzle head is movable along a second axis, the first axis being parallel to the second axis or the first axis being aligned with the second axis, the nozzle head outlet facing at least partially in a feed direction of the nozzle head.

2. A device according to claim 1, wherein the abrasive agent comprises at least one of garnet sand, glass, slag, olivines and corundum.

3. A device for water abrasive cutting, the device comprising:

a water abrasive cutting device structure comprising:

a pressure pump;

a suspension comprising a fluid and an abrasive agent;

a fluid driven motor driven via a flow of the suspension;

a nozzle head comprising a nozzle head rear end portion and a nozzle head front end portion located opposite the nozzle head rear end portion, the fluid driven motor being connected to the nozzle head rear end portion, the nozzle head front end portion comprising a nozzle head outlet, the nozzle head outlet defining at least a portion of a suspension flow path for discharging the suspension for a fluid abrasive cutting to machine and cut a surface of a material, the nozzle head being rotatable about a first axis via the fluid driven motor, wherein the nozzle head is movable along a second axis, the first axis being parallel to the second axis or the first axis coinciding with the second axis, the nozzle head front end portion comprising an outer peripheral surface oriented in a direction of movement of the nozzle head, the outer peripheral surface defining at least a portion of the nozzle head outlet, wherein the abrasive agent comprises at least one of garnet sand, glass, slag, olivines and corundum.

* * * * *